United States Patent [19]

Wehrli

[11] 4,418,481

[45] Dec. 6, 1983

[54] APPARATUS FOR THE DEHUMIDATION AND DRYING OF DAMP STRUCTURES

[76] Inventor: Walter Wehrli, Hotel Bahnhof, Urnäsch, Switzerland

[21] Appl. No.: 196,881

[22] Filed: Oct. 14, 1980

[51] Int. Cl.[3] ..... F26B 23/04

[52] U.S. Cl. ..... 34/1

[58] Field of Search ..... 34/1

[56] References Cited

FOREIGN PATENT DOCUMENTS 109049 10/1974 Fed. Rep. of Germany .

OTHER PUBLICATIONS

"Study of the Effectiveness of Systems for Drying Walls Affected by Capillary Rising of Humidity". . . , Int'l. CIB/RILEM Symposium–2nd Proceedings, 1974, paper 2,2,2.

*Primary Examiner*—Larry I. Schwartz

*Attorney, Agent, or Firm*—Karl W. Flocks; A. Fred Starobin

[57] ABSTRACT

An apparatus for the dehumidification and drying of damp structures specifically of walls of buildings comprises a first spirally wound electric coil connected at each end to a respective terminal of a first condenser located in the center of the coil. A further coil and condenser arrangement is provided, which arrangement is identical to the first mentioned arrangement. The two coils are located relative to each other such that the planes described from the coils intersect each other at right angles. The two coils with their condensers are arranged in a closed plastic boxlike container.

8 Claims, 1 Drawing Figure

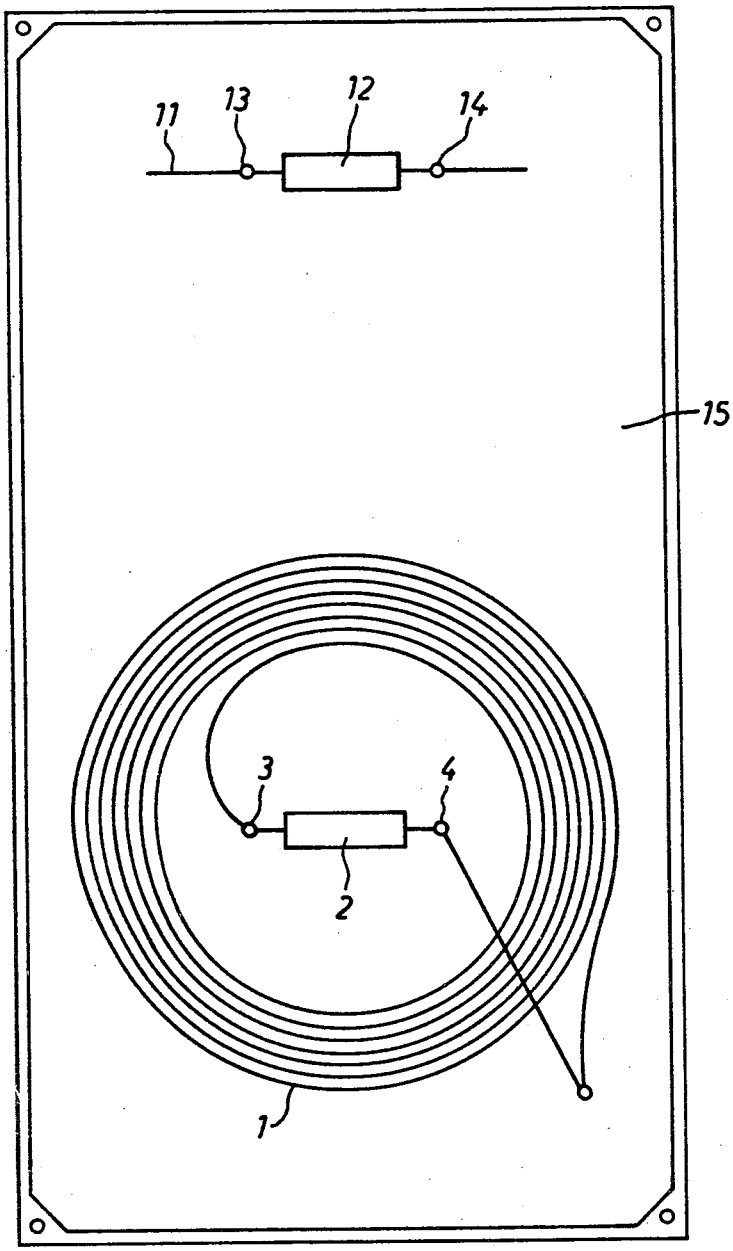
11
13
12
14
15
3
4
2
1

APPARATUS FOR THE DEHUMIDATION AND DRYING OF DAMP STRUCTURES

BACKGROUND OF THE INVENTION

1. Field of the Invention

The present invention relates to an apparatus for the dehumidification and drying of damp structures.

The open circulation of water within a damp wall e.g. of a building due to the osmotic pressure proceeds from the lower end of the wall upwards and at the upper end the water is led towards the outside by evaporization thereof. It is known that this transport of water generates an electrical field extending in the direction of the rising dampness. This electric field acts as a pump.

The influence of the electrical fields existing in a damp wall of a building structure onto the flowing liquid is that great that a safe elimination of such electrical fields leads to a tangible reduction of the rising water or dampness, respectively, in such wall structure. The dynamic of the transport of the water is controlled decisively in that at an upper end of the wall a larger volume of water is evaporated than enters into the wall from below, which obviously leads to an elimination of a formation of large masses of the transported liquid.

It is known that the rising of the dampness from the ground in a capillary arrangement is bound to several physical causes which however are hardly measureable. It is, furthermore, known since a considerable time that streams of water extending below the ground surface and certain superpositions further below in the ground (so-called irritant areas) cause physical changes at ground level and in the ambient air.

Conclusively, a mean gradient height or hydraulic height of the ground water within the ground generates a considerable potential gradient of the field formed thereby. On the other hand it has been possible to measure above certain ground areas, at the irritation strips abnormal effects of the conductivity of the ground and extraordinary maximum values of the resistance of the ground, which measurements have been repeatedly made.

Quite obviously such electro-physical changes existing at ground surface will influence at least locally the electro-physical procedures in a wall structure as well as the concentration of ions in the air. Accordingly, in the region of water streaming below the surface electrical and magnetic fields are generated which vary strongly regarding force and intensiveness. The influence of electromagnetical fields having predetermined frequency ranges on the water such to alter its electrical conductivity can be a further influencing factor regarding the dampening of wall structures due to the rising moistness from the ground.

During the past years it has been proven in practice that rising ground dampness has almost in every case been connected with abnormal electrical and magnetical field forces within and above ground. Therefore, it has been a general object to decrease decisively specifically these abnormal forms of fields in addition to the difference of potentials in the capillary system of the wall structure as well as of the concentration of the ions in the air.

2. Description of the Prior Art

All hitherto known methods for drying building structures are based commonly on a principle of an elimination of electrical fields existing in such damp building structures or on the formation of electrical counter-fields by means of so-called electro-osmotic methods, respectively. Further methods suggest to use so-called dipoles or electrical conductors which must be inserted into the walls and necessitate partly considerable structural changes thereof. All these known methods and devices, however, incorporate basically the same drawback, in that the electrodes must always be inserted into the wall structure in accordance with a predetermined pattern or arrangement. For instance, a plurality of electrical conductors made of different metals with differing potentials of the electrochemical series have been arranged in so-called tracer planes extending relative to each other parallel over each other, which conductors have been interconnected electrically.

Other apparatuses of different constructions have been made for the same purpose. As a rule, they are operated by an electrical battery or are provided with a connection to the lighting means of the respective building. These apparatuses have in common the drawback that they must be positioned close to the electrical outlets in the building or then in that extensive and expensive connecting lines must be provided. Furthermore, there is the danger that they get charged themselves within a relative short time span or that they are destroyed by corrosion. Usually the range of action or range of influence, respectively, of all these known apparatuses is limited to a few meters only, such that it is necessary to position in larger buildings at least two or more such apparatuses. A further decisive drawback is that all hitherto known apparatuses operate in only one single predetermined direction, i.e. they must be positioned exactly according to the polarity in a north-south direction and must be positioned, furthermore, at the intersection of the streams of water flow; otherwise they will not operate at all.

SUMMARY OF THE INVENTION

An object of the invention is to provide an apparatus which can be placed with an as small as possible expenditure, yet increased results such in dampness prone building structures that it is no longer necessary to consider the polarity nor the found abnormalities of the ground such that the apparatus can be placed by every person indiscriminately in a building structure. A further object is to provide an apparatus which safely covers the areas of the maximum gradients of the electrical or magnetical fields such that the maximal decreasing influence onto the vertical transports of the liquid in dampness prone building structures is achieved.

Now, in order to implement these and still further objects of the invention, which will become more readily apparent as the description proceeds, the apparatus of this development is manifested by the features of comprising a first spirally wound flat electric coil connected at each end to a respective terminal of a first condenser and comprising further a second spirally wound flat electric coil connected at each end to a respective terminal of a second condenser, whereby the plane defined by said first coil extends perpendicularly to the plane defined by said second coil.

BRIEF DESCRIPTION OF THE DRAWINGS

The present invention will be more fully understood by reference to the following detailed description thereof, when read in conjunction with the attached drawings, and wherein:

The sole FIGURE shows the view of a section of an embodiment of the inventive apparatus.

DETAILED DESCRIPTION OF THE PREFERRED EMBODIMENT

The single FIGURE shows a top view of a section of a rectangular container 15 made of a plastics material. Within this container there is arranged a first spirally wound flat electric coil 1 which may be formed by a printed circuit or in accordance with a further embodiment may be a copper coil. The two ends 3, 4 of this first electric coil are connected to a first electrical condenser identified by the reference numeral 2. The capacity of this condenser is in accordance with a first preferred embodiment about 0.5 $\mu$F and in accordance with a further embodiment its capacity amounts to about 1.0 $\mu$F.

A second identical spirally wound flat electric coil 11 is arranged adjacent to the first electrical coil 1 and arranged such that it extends in a plane extending at a right angle to the plane defined by coil 1. The second coil 11 is connected at its respective ends 13 and 14 again to a second condenser 12. The condensers 2 and 12, respectively, are arranged exactly in the center of their respective coils 1 and 11. The winding, material and electric data of the first coil 1 and first condenser 2 is/are identical to the values of the second coil 11 and condenser 12.

This apparatus utilizes the energy of the interference fields or stray fields, respectively, and utilizes these fields for its own operation in accordance with the rising or diminishing of these fields. Specifically the energy of these stray fields is led to the two resonance circuits or oscillatory circuits, respectively, formed by the two coils and condensers as is well known in the art. These two oscillatory circuits generate in turn electrical oscillations in a general range between 0.2–16 kHz. Due to the interference of the existing wave fields these will now be eliminated at least in the region of the presently measurable values. The effect is now a measurable decrease of the electrogenetically generated difference of potentials as well as of the ion concentration of the air due to the earlier mentioned rising liquids, i.e. dampness.

An important feature of the systems shown with its generation of a natural oscillation and accordingly, a periodical changing of one form of energy to another form of energy. Thereby, a total energy which is supplied only once to the system from the outside is maintained because the oscillation obviously has no friction. In other words, the energy oscillates between two energy storage means, i.e. between the coil and the condenser. For sake of good order it must be said that there is a periodical change of electrical into magnetic energy due to, on one hand, the condenser having a capacity C and a coil having an inductivity L.

Due to the above disclosed arrangement of the circuits the use of the inventive apparatus is quite simple because polarities or a directional arrangement of the box must not be considered for the operation. Accordingly, in use the apparatus can be placed within a dampness prone structure or building, respectively, at any arbitrarily chosen location. Thereby the location as well as the extent of above mentioned abnormal situations of the ground must not be taken into consideration. Of importance is merely that one of the coils 1 or 11, respectively, lies in a plane extending roughly parallel to the ground surface. If both of the perpendicularly intersecting planes extend also perpendicularly to the ground surface, the apparatus is inoperative and thus can be stored in such position. The operative area of the apparatus can extend up to 10,000 meters.

It is a well known fact, that the rising dampness of the ground is always coupled to abnormal electrical and magnetical field intensities which can be ascertained easily and exactly by means of corresponding measuring instruments. As soon as the inventive apparatus is placed inside a dampness prone structure or building, respectively, it begins to operate which can easily be ascertained by means of corresponding electrical measuring instruments because as soon as the apparatus begins to operate, the field intensity as well as the change of the ionization begin to take place. By means of the inventive apparatus and its positioning in the building, the areas of concentration of the carriers of the electric potential in mentioned dampness prone buildings, which carriers of potential are the sources of the electrical fields and thus generate the vertical rising of the water, will be eliminated and counteracted such that any dampness prone building structure with its regarding the special arrangement quite variable electrical potentials of their water bearing areas can be dried successfully.

While there is shown and described a present preferred embodiment of the invention, it is to be distinctly understood that the invention is not limited thereto, but may be otherwise variously embodied and practiced within the scope of the following claims. ACCORDINGLY,

What is claimed is:

1. An apparatus for the dehumidation and drying of damp structures, comprising a first spirally wound flat electric coil connected at each end to a respective terminal of a first condenser and comprising further a second spirally wound flat electric coil connected at each end to a respective terminal of a second condenser, the plane defined by said first coil extending perpendicularly to the plane defined by said second coil, said apparatus being mounted substantially adjacent to said damp structure to be dried wherein said apparatus generates an electric field which is in opposition to that naturally occurring in the damp structure, said generated electric field acting to force moisture from said damp structure.

2. The apparatus of claim 1, wherein said first coil and said first condenser are structured identically to said second coil and said second condenser.

3. The apparatus of claim 2, wherein said first and said second condenser are each a metal-paper condenser.

4. The apparatus of claim 3, wherein each condenser is arranged in the center of its respective coil.

5. The apparatus of claim 1, wherein said first and said second coil are defined each by an electric conductor of a printed circuit and wherein said coils and said condensers are arranged inside a closed container made of a plastics material.

6. The apparatus of claim 1, wherein said first and said second coil are defined each by a copper wire and wherein said coils and said condensers are arranged inside a closed container made of a plastics material.

7. The apparatus of claim 3, wherein said condensers have a capacity of about 0.5 $\mu$F each.

8. The apparatus of claim 3, wherein said condensers have a capacity of about 1.0 $\mu$F each.

* * * * *